US005522762A

United States Patent [19]

Pineau

[11] Patent Number: 5,522,762

[45] Date of Patent: Jun. 4, 1996

[54] TOOL FOR APPLYING SURFACE COATED ABRASIVES FOR USE ON A MACHINE FOR ABRASION MACHINING OF CYLINDRICAL SURFACES ON WORKPIECES

[75] Inventor: Jean C. Pineau, Chailly en Bière, France

[73] Assignee: Societe Procedes Machines Speciales S.P.M.S., Evry Cedex, France

[21] Appl. No.: 210,506

[22] Filed: Mar. 18, 1994

[30] Foreign Application Priority Data

Mar. 18, 1993 [FR] France ..... 93 03156

[51] Int. Cl.[6] ..... B24B 5/00; B24B 21/00

[52] U.S. Cl. ..... 451/163; 451/540

[58] Field of Search ..... 51/145 R, 154; 451/21, 163, 461, 540

[56] References Cited

FOREIGN PATENT DOCUMENTS 0219301 4/1987 European Pat. Off. .
0338224 10/1989 European Pat. Off. .
0366506 5/1990 European Pat. Off. .
8602817 4/1986 Germany .

*Primary Examiner*—Joseph M. Gorski
*Attorney, Agent, or Firm*—Helfgott & Karas

[57] ABSTRACT

A tool for applying surface coated abrasives on a machine for abrasion machining of cylindrical bearing surfaces on workpieces such as crankshaft journals and crankpins comprises for each bearing surface to be machined a pivoted arm mobile vertically and three pads for applying surface coated abrasives. A first pad is mounted at a median top position on the arm and the other two at lateral bottom positions on two jaws articulated to the arm and coupled together so that they can be clamped together so that when clamped onto the bearing surface to be machined the three pads are disposed substantially at the three corners of an equilateral triangle. Each pad has a concave surface coated abrasive application surface subtending an angle of greater than 60° so that after clamping the three pads of each arm enclose the bearing surface to be machined substantially completely. The median top pad is mounted on the arm with limited mobility in horizontal translation perpendicular to the axis of the bearing surface and the bottom lateral pads are each mounted on a respective jaw with limited freedom to oscillate transversely to the axis of the bearing surface.

4 Claims, 1 Drawing Sheet

TOOL FOR APPLYING SURFACE COATED ABRASIVES FOR USE ON A MACHINE FOR ABRASION MACHINING OF CYLINDRICAL SURFACES ON WORKPIECES

BACKGROUND OF THE INVENTION

1. Field of the Invention

The present invention concerns a tool for applying surface coated abrasives for use on a machine for abrasion machining of cylindrical surfaces on workpieces, especially crankshaft journals and crankpins.

2. Description of the Prior Art

Machines of this type described, for example, in patent application EP-A-0 366 506 comprise, for each bearing surface to be machined on a workpiece, a pivoting arm mobile vertically and carrying three surface coated abrasive application pads disposed substantially at the three corners of an equilateral triangle. A first of the three pads is mounted at a median top position on the arm and the other two in lateral bottom positions on two jaws articulated to the arm and coupled so that they can be clamped together by synchronous pivoting in opposite directions due to the action of common maneuvering means. The arm is moved vertically by a balancing cylinder with regulated feed pressure. When the jaws are clamped the three pads apply surface coated abrasives to the bearing surface to be machined with a uniform pressure.

In the prior art machines the pads which apply the surface coated abrasives have an application surface in the shape of a circular arc subtending a relatively small angle, usually less than 30°. These tools give good results in terms of the bearing surface finish.

For honing cylindrical bearing surfaces on workpieces "hones" are used whose surface in contact with the bearing surface to be machined is in the shape of a circular arc subtending an angle of up to 60°. The hones wear asymmetrically during machining so that in practise they exert pressure and therefore their action of honing the cylindrical bearing surface on the workpiece over an angle significantly less than 60°.

In other prior art machines using surface coated abrasives the tools in contact with each cylindrical bearing surface to be machined comprise two opposed surface coated abrasive application pads disposed on two jaws of a clamp, each pad having a circular arc shape application surface subtending an angle of almost 180°. The drawback of these prior art pads used in pairs is poor distribution of the application pressure. The pressure is inevitably concentrated in the median part of the circumferential length of the circular arc shaped surface of the two opposed pads.

None of the prior art tools constitutes an entirely satisfactory response to the severe demands in terms of precision that apply nowadays, for example with respect to the absence of shape defects and to the straightness of crankshaft journals and crankpins.

The present invention is directed to a tool for applying surface coated abrasives enabling more accurate machining by abrasion of cylindrical bearing surfaces on workpieces such as crankshaft journals and crankpins.

SUMMARY OF THE INVENTION

The surface coated abrasive application tool of the present invention is for a machine for abrasion machining of cylindrical bearing surfaces on workpieces such as crankshaft journals and crankpins of the type comprising for each bearing surface to be machined a pivoted arm mobile vertically and carrying three surface coated abrasive application pads disposed substantially at the three corners of an equilateral triangle. According to the invention, each pad has a circular arc shape concave application surface subtending an angle of greater than 60° and less than 120° so that the three pads enclose substantially all of the bearing surface to be machined.

By virtue of their enveloping shape over slightly less than 120° and the specific way they are mounted on the arm, the three pads apply the surface coated abrasive against the bearing surface to be machined not only all with the same pressure but also with substantially uniform pressure over all their circumferential length. This ensures optimal compensation of any shape defects (ovalization, out-of-round, etc) of the bearing surface.

To enable optimal location of the top pad of a machine according to application EP-A-0 366 506 relative to the bearing surface to be machined the pad is advantageously mounted with limited mobility in horizontal translation perpendicular to the axis of the bearing surface to be machined.

On this same type of machine each lateral pad is advantageously mounted with limited freedom to oscillate perpendicularly to the axis of the bearing surface to be machined.

Each pad preferably comprises a rigid base faced with a more flexible material having a low coefficient of friction.

This facing may comprise a synthetic rubber vulcanized onto the base, for example.

The facing may advantageously have along its axis of curvature a hardness which increases from the middle towards both ends.

In one preferred embodiment of the invention the facing may comprise five sections, a median section of low hardness followed towards each end by an intermediate section of medium hardness followed by an end section of high hardness.

These three hardnesses may be Shore hardnesses of 90, 95 and 98, for example.

One illustrative embodiment of a tool according to the invention is described in more detail hereinafter by way of non-limiting example and with reference to the appended diagrammatic drawings.

DESCRIPTION OF THE PREFERRED EMBODIMENT

Figure 1:
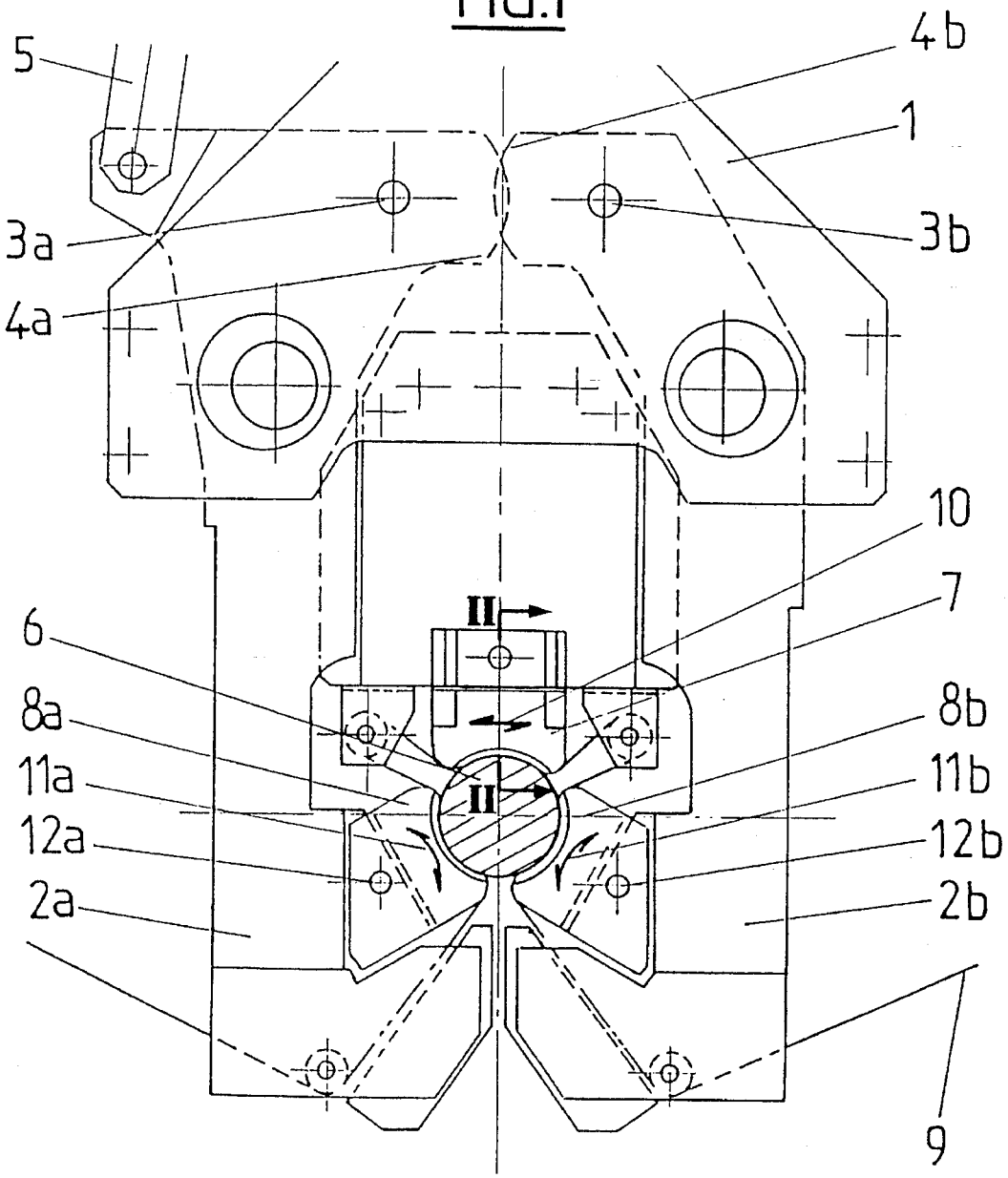
FIG. 1 is a general view of the lower part of an arm carrying a tool in accordance with the present invention.

Referring to the drawings, the tool in accordance with the invention is used on a machine as described in patent application EP-A-0 366 506 for abrasion machining of cylindrical bearing surfaces on workpieces, especially machining of crankshaft journals and crankpins using surface coated abrasives. FIG. 1 shows an arm 1 mounted on a vertically mobile slider (not shown) to pivot freely about a horizontal axis. The arm 1 carries two jaws 2*a* and 2*b* articulated to it by horizontal pivot pins 3*a* and 3*b* and coupled by toothed segments 4*a*, 4*b* so that they can be clamped together by synchronous pivoting in opposite directions relative to the arm 1 due to the action of a common maneuvering cylinder 5.

To machine by abrading the cylindrical bearing surface 6 a first pad 7 is mounted in a median position on the arm 1 and two other pads 8*a* and 8*b* are mounted in lateral positions on the two jaws 2*a* and 2*b* so that when the three pads 7, 8*a* and 8*b* are clamped against the cylindrical bearing surface 6 to be machined by the cylinder 5, in order to apply surface coated abrasives 9 against the bearing surface 6, the three pads 7, 8*a* and 8*b* are substantially at the three corners of an equilateral triangle by virtue of the balancing of the mass of the arm 1 by balancing means (not shown) such as a regulated feed pressure cylinder, the three pads are applied against the bearing surface 6 to be machined with a uniform pressure.

According to the invention each pad 7, 8*a* and 8*b* subtends an angle of slightly less than 120° so that the three pads envelop the bearing surface 6 to be machined almost completely.

As shown by the double-headed arrow 10, the top median pad 7 is mounted on the arm 1 with limited mobility in horizontal translation perpendicular to the axis of the bearing surface 6. As shown by the double-headed arrows 11*a* and 11*b* the bottom lateral pads 8*a*, 8*b* are mounted on the jaws 2*a* and 2*b* by horizontal pivot pins 12*a* and 12*b* with limited freedom to oscillate perpendicular to the axis of the bearing surface 6 to be machined. The mobility of the three pads 7, 8*a* and 8*b* ensures an optimal match of the pads to the bearing surface 6 to be machined, independently of tolerances of the arm 1 and especially any play that there may be at the toothed segments 4*a*, 4*b* coupling the two jaws 2*a* and 2*b*.

Figure 2:
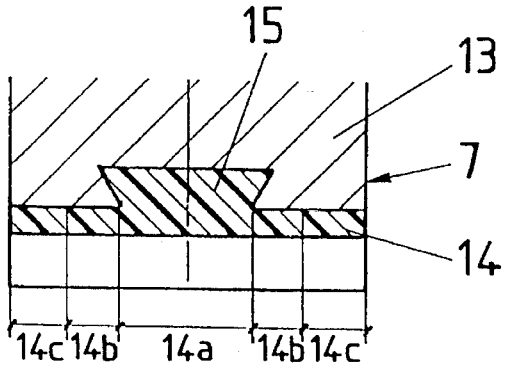
FIG. 2 is a partial cross-section through a carrier on the line II—II in FIG. 1 and to a larger scale.

As shown in FIG. 2 in particular, the top pad 7 comprises a rigid, in this example metal base 13 whose circular arc shape concave interior surface has a facing 14 of a more flexible material with a low coefficient of friction, for example a vulcanized synthetic rubber. A dovetail profile 15 improves the fixing of the facing 14 to the base 13.

Given that abrasion machining of the cylindrical bearing surface 6 involves not only rotational movement of the bearing surface 6 but also, in the known manner, an oscillatory movement of the bearing surface 6 along its axis (in order to obtain a "cross-hatched" machining pattern), and given that the width of each pad 7, 8 is less than the width of the bearing surface 6 to be machined, the two end portions of the width of the bearing surface 6 are machined only alternately whereas the median part is machined continuously, which can lead to defects in terms of the straightness of the bearing surface. To compensate such defects of straightness the facing 14 may advantageously comprise along its axis of curvature a plurality of sections of different hardness, increasing from the middle towards both ends. In FIG. 2 these different hardnesses are symbolically represented by the subdivision of the facing 14 into five sections, namely a median section 14*a*, two intermediate sections 14*b* and two end sections 14*c*, these sections having respective Shore hardnesses of 90, 95 and 98, for example.

It goes without saying that the above embodiment has been described by way of non-limiting illustrative example only and that many modifications and variations are feasible within the scope of the invention.

For example, the tool in accordance with the invention could be used on machines other than that described in patent application EP-A-0 366 506 even though the latter machines give particularly favorable results.

Note also that in the context of the invention the pads can have an angular length greater than 60° and less than 120°, preferably between about 90° and 110°.

There is claimed:

1. A tool for abrasive machining cylindrical bearing surfaces in a machine for abrasive machining of workpieces such as journals and crankpins on crankshafts, and comprising for each bearing surface to be machined an arm mounted in the machine to move vertically and to freely pivot, and two jaws hinged on said arm to be coupled to each other, the tool comprising three pads for applying an abrasive strip against the bearing surface to be machined, means for clamping said three pads against said bearing surface, each of said pads having a concave, abrasive strip-applying surface subtending an angle greater than 60° and smaller than 120°, a first of said pads being mounted on said arm at a median high position with limited mobility in horizontal translation perpendicular to an axis of a workpiece having the bearing surface to be machined and other two pads being mounted on said two jaws, respectively, with limited freedom to oscillate transversely to the axis of the workpiece having said bearing surface, at opposite lateral positions lower than said first pad, such that after clamping of the three pads against the bearing surface to be machined by said clamping means, the three pads are disposed substantially at three corners of an equilateral triangle, to substantially completely circumferentially enclose the bearing surface to be machined and apply the abrasive strip with same and substantially uniform pressure over all circumferential length thereof against the bearing surface to be machined, each of said pads comprising a rigid base and a facing of a flexible material with a low coefficient of friction defining said concave abrasive strip-applying surface, said facing comprising along the axis of the workpiece having the bearing surface to be machined a plurality of sections of different hardness, the hardness increasing from a middle section toward two end sections.

2. The tool according to claim 1, wherein said middle section has low hardness and is followed toward each end by one intermediate section of medium hardness followed by one end section of high hardness.

3. The tool according to claim 1, wherein said middle section has a Shore hardness of 90 and is followed toward each end by one intermediate section having a Shore hardness of 95 followed by one end section having a Shore hardness of 98.

4. The tool according to claim 1, wherein said facing is made from vulcanized synthetic rubber.

* * * * *